US012716376B2

(12) United States Patent
Mueller et al.

(10) Patent No.: US 12,716,376 B2
(45) Date of Patent: Aug. 25, 2026

(54) METHOD FOR OPERATING AN EXHAUST GAS POST-TREATMENT DEVICE FOR AN INTERNAL COMBUSTION ENGINE OF A MOTOR VEHICLE, IN PARTICULAR OF A MOTOR CAR

(71) Applicant: Mercedes-Benz Group AG, Stuttgart (DE)

(72) Inventors: Siegfried Mueller, Ingersheim (DE); Michael Heinrichsmeyer, Steinheim (DE); Heiko Beil, Stuttgart (DE); Christian Dominik Ladwig, Stuttgart (DE)

(73) Assignee: Mercedes-Benz Group AG, Stuttgart (DE)

( * ) Notice: Subject to any disclaimer, the term of this patent is extended or adjusted under 35 U.S.C. 154(b) by 0 days.

(21) Appl. No.: 18/700,925

(22) PCT Filed: Sep. 26, 2022

(86) PCT No.: PCT/EP2022/076654
§ 371 (c)(1),
(2) Date: Apr. 12, 2024

(87) PCT Pub. No.: WO2023/061734
PCT Pub. Date: Apr. 20, 2023

(65) Prior Publication Data

US 2024/0410306 A1 Dec. 12, 2024

(30) Foreign Application Priority Data

Oct. 14, 2021 (DE) ..... 10 2021 005 146.7

(51) Int. Cl.
*F01N 3/20* (2006.01)
*F01N 3/10* (2006.01)

(52) U.S. Cl.
CPC ..... *F01N 3/208* (2013.01); *F01N 3/103* (2013.01); *F01N 3/2033* (2013.01);
(Continued)

(58) Field of Classification Search
CPC ..... F01N 3/208; F01N 3/2033; F01N 3/103; F01N 2900/1602; F01N 2240/16; F01N 2430/08; Y02T 10/12; Y02A 50/20
See application file for complete search history.

(56) References Cited

U.S. PATENT DOCUMENTS 10,113,460 B2 10/2018 Balthes et al.
11,092,050 B2 * 8/2021 Matsumura ..... F02D 43/00
(Continued)

FOREIGN PATENT DOCUMENTS

DE 10 2010 035 007 A1 2/2012
DE 10 2019 119 123 A1 1/2021
(Continued)

OTHER PUBLICATIONS

International Search Report (PCT/ISA/210) issued in PCT Application No. PCT/EP2022/076654 dated Jan. 16, 2023 (2 pages).
Japanese-language Office Action issued in Japanese Application No. 2024-522086 dated Jun. 24, 2025 (3 pages).

*Primary Examiner* — Phutthiwat Wongwian
*Assistant Examiner* — Diem T Tran
(74) *Attorney, Agent, or Firm* — Crowell & Moring LLP

(57) ABSTRACT

A method for operating an exhaust gas post-treatment device for an internal combustion engine. The exhaust gas post-treatment device has an oxidation catalyst having a catalytic coating, a heating element upstream of the oxidation catalyst or a heating element provided with the catalytic coating with which heat energy can be introduced actively into the exhaust system at a heating point. The exhaust gas post-treatment device further has a dosing element with which a reducing agent can be introduced into the exhaust gas at an
(Continued)

introduction point arranged downstream of the oxidation catalyst and has an SCR system arranged downstream of the introduction point. The method provides checking whether target temperatures have been reached in the exhaust gas system. If the target temperatures are fallen short of, the target temperatures can be reached within a defined period of time by using the heating element and by carrying out a post-injection.

4 Claims, 1 Drawing Sheet

(52) U.S. Cl.
CPC ..... *F01N 3/2066* (2013.01); *F01N 2240/16* (2013.01); *F01N 2900/1602* (2013.01)

(56) References Cited

U.S. PATENT DOCUMENTS

| | | | | |
|---|---|---|---|---|
| 2008/0223019 | A1 | 9/2008 | Gonze et al. | |
| 2012/0324868 | A1* | 12/2012 | Kim | B60W 10/30 60/274 |
| 2017/0096923 | A1* | 4/2017 | Chiffey | B01J 35/56 |
| 2017/0167342 | A1 | 6/2017 | Balthes | |

FOREIGN PATENT DOCUMENTS

| | | | |
|---|---|---|---|
| EP | 3 099 905 | B1 | 12/2016 |
| JP | 2011-231718 | A | 11/2011 |
| JP | 2015017515 | * | 1/2015 |
| JP | 204163811 | * | 2/2015 |
| JP | 2017-25729 | A | 2/2017 |
| KR | 20200134576 | * | 12/2020 |

* cited by examiner

METHOD FOR OPERATING AN EXHAUST GAS POST-TREATMENT DEVICE FOR AN INTERNAL COMBUSTION ENGINE OF A MOTOR VEHICLE, IN PARTICULAR OF A MOTOR CAR

BACKGROUND AND SUMMARY OF THE INVENTION

The invention relates to a method for operating an exhaust gas post-treatment device for an internal combustion engine of a motor vehicle, in particular of a motor car.

Such a method for operating an exhaust gas post-treatment device for an internal combustion engine, also described as a combustion engine, of a motor vehicle, in particular of a motor car, should for example already be taken as known from EP 3 099 905 B1. In the method, the exhaust gas post-treatment device, which can be flowed through by exhaust gas of the internal combustion engine, has an oxidation catalyst having a catalytic coating, which oxidation catalyst is thus at least partially formed by catalytic coating. The exhaust gas post-treatment device further comprises a heating element, which is designed to cause an active introduction of heat energy into the exhaust gas and/or into the oxidation catalyst at a heating point, and thus to actively heat the exhaust gas and/or the oxidation catalyst at the heating point. The heating element is designed as a heating element arranged upstream of the oxidation catalyst, and thus upstream of the catalytic coating, such that the heating point is arranged upstream of the oxidation catalyst or upstream of the heating point, or the heating element is designed as a heating element provided with the catalytic coating, and is thus connected to the oxidation catalyst, or is a component part of the oxidation catalyst. A dosing element is also provided, by means of which, at an introduction point arranged downstream of the oxidation catalyst and downstream of the heating point, a for example fluid reducing agent, in particular for denitrifying the exhaust gas, can be introduced into the exhaust gas. The exhaust gas post-treatment device additionally comprises an SCR system arranged downstream of the introduction point, which can in particular have an SCR catalyst and a particle filter.

DE 10 2019 119 123 A1 further discloses a method for heating an exhaust gas post-treatment system of an internal combustion engine.

The object of the invention is to develop a method of the kind specified in the introduction such that the exhaust gas post-treatment device can be heated particularly advantageously, and thus a particularly low-emission operation can be implemented.

In order to develop a method of the kind specified herein such that the exhaust gas post-treatment device can be heated particularly advantageously, and thus a particularly low-emission operation can be implemented, it is provided according to the invention that if it is determined in a first step of the method, for example by means of an electronic computer for operating, in particular for controlling or regulating the exhaust gas post-treatment device, that a first temperature downstream of the heating point, and thus downstream of the heating element, and a second temperature of the SCR system, in particular of the SCR catalyst, lie below respective assigned target temperatures, and if it is determined that component protection temperatures for protecting components of the exhaust gas post-treatment device are not exceeded, and if it is determined that a minimum temperature for carrying out a post-injection of the internal combustion engine has been reached or exceeded, a temperature rise is calculated by which the temperature of the SCR system should be increased, i.e., must be increased, so that the second temperature of the SCR system at least reaches, i.e., reaches or exceeds, the assigned target temperature. If, for example, in a second step of the method, in particular by means of the electronic computer, it is determined that the temperature rise cannot be caused within a pre-determined period of time by means of the heating element alone, i.e., without carrying out the post-injection, an active heating of the exhaust gas, and thus of the SCR system, is carried out both by means of an active heating element and by carrying out the post-injection of the internal combustion engine. If, however, in the second step, in particular by means of the electronic computer, it is determined that the temperature rise can be caused within the pre-determined period of time by means of the heating element, in particular without carrying out the post-injection, then an active heating of the exhaust gas, and thus of the SCR system, is carried out by means of the heating element, wherein the post-injection is not carried out.

The method according to the invention is thus an operating strategy for particularly quickly heating the exhaust gas post-treatment device preferably designed as an exhaust gas system close to the engine, and keeping the latter warm, in particular by a combination of at least one active heating measure in the form of the heating element and the post-injection. The method in particular makes it possible to bring the exhaust gas post-treatment device up to its advantageous target temperature for post-treating the exhaust gas or to maintain the target temperature. The following facts and considerations are in particular the basis of the invention: The exhaust gas post-treatment device, which is also described as an exhaust gas system, for example serves to reduce engine pollutants, which are provided by the internal combustion engine for example designed as a diesel engine, and are contained in the exhaust gas. Because the internal combustion engine is for example designed as a diesel motor, the oxidation catalyst is for example designed as a diesel oxidation catalyst (DOC). The catalytic coating of the oxidation catalyst is thus designed to oxidize constituents contained in the exhaust gas, e.g., unburned hydrocarbons (HC) and carbon monoxides (CO). The internal combustion engine also described as a motor is preferably operated superstoichiometrically and therefore leanly, i.e., with an superstoichiometric, and thus lean mixture of air and fuel, as a result of which the exhaust gas is, so to speak, lean. To purify the exhaust gas, different components and measures are installed in the exhaust gas system. A first of the measures is the oxidation catalyst, which is preferably the first catalyst in the flow direction of the exhaust gas flowing through the exhaust gas system. The oxidation catalyst is a catalyst with oxidation functionality, wherein the oxidation catalyst can additionally have a nitric oxide storage functionality (NOx functionality), and thus the functionality of a nitric oxide storage catalyst (NSK). For example, in front of, and possibly, in addition, also behind the oxidation catalyst, an active heating measure can be arranged. The active heating measure is implemented by a heating device such as the previously specified heating element. If, in the following, the or a active heating measure is mentioned, unless otherwise specified, the heating element should be understood to be meant. The active heating measure can for example be an electrically heatable element, which is for example designed such that it can emit heat to the exhaust gas flowing by, in particular at the heating point. The electrically heatable element can be arranged upstream of the oxidation catalyst, and thus upstream of the catalytic coating, or the electrically heatable element can be connected to the oxidation catalyst, and can thus be coated with the catalytic coating also described as a catalytically active material. As an alternative, instead of or in combination with the electrically heatable elements, another active heating measure, e.g., a burner, can be provided, by means of which heat can be introduced into the exhaust gas, in particular at the heating point. For example, by means of the burner, a fuel is burned, in particular without a flame or while forming a flame, whereby heat or heat energy can be introduced into the exhaust gas at the heating point.

The introduction point, and thus a dosing, and preferably also a mixing section along which the reducing agent introduced into the exhaust gas is mixed with the exhaust gas, are arranged downstream of the oxidation catalyst, and preferably also downstream of the heating point. Preferably, the reducing agent is an aqueous urea solution, which can provide ammonia (NH3) for denitrifying the exhaust gas. The SCR system for example designed as a hot end SCR system is arranged downstream of the introduction point, the SCR system having at least one or more SCR catalysts. The respective SCR catalyst is for example formed by an SCR block. The SCR system additionally comprises the particle filter. The particle filter is for example a diesel particle filter (DPF). The particle filter can be provided with a further catalytic coating designed as an SCR coating. The particle filter can for example be an SDPF. In particular, a further dosing unit for introducing the reducing agent into the exhaust gas can be located in an underbody of the exhaust gas system, in particular next to a further SCR catalyst and an ammonia slip catalyst (ASC), in order to convert, i.e., to reduce, nitric oxides additionally contained in the exhaust gas, and to remove potential NH3 slip from the exhaust gas.

The aim of this structure is an advantageous exhaust gas post-treatment device, in which, in particular by using the at least one or several active heating measures, temperatures are adjusted in the exhaust gas system as quickly as possible and reliably during further operation, such that pollutant emissions are effectively converted. However, depending on the driving state, the exhaust gas mass flows are so high that the heat introduced into the exhaust gas system is largely removed from the components to be heated again, which can lead to a slower or insufficient heating or heat retention, because the heat input power is technically limited via the active heating measure (aHM). An undesirably ineffective exhaust gas post-treatment can thus result.

For this reason, the previously specified operating strategy is suggested, in which the required heat input power is achieved by a combination of the active heating measure or heating measures on the one hand, and starting at least one post-injection on the other. The goal is to quickly heat the exhaust gas system to temperatures at which almost all pollutant emissions are effectively converted. The first target temperature assigned to the first temperature downstream of the heating point, also labelled T_DownstreamOf_aHM, is for example 250 degrees Celsius. The second target temperature assigned to the second temperature of the SCR system, in particular of the SCR catalyst, also labelled T_SCR, is for example 225 degrees Celsius.

For this purpose, the temperature rise required to heat the exhaust gas system, which is also labelled Intended_T_Rise, is for example first calculated, in particular depending on the exhaust gas mass flow. Via the heat input power, the exhaust gas mass flow and the heat capacity of the exhaust gas, it is calculated by how much the exhaust gas is heated upstream of the SCR system, in particular upstream of the SCR catalyst, in comparison with a temperature upstream of the active heating measure (aHM) or upstream of the heating point, by the active heating measure (DeltaT_aHM). If the heat input power required to generate the temperature rise cannot be provided quickly enough by the active heating measure or by the active heating measures (control difference greater than >0), exothermic energy is additionally introduced into the exhaust gas system by starting post-injection. It should in particular be considered that a post-injection can only be permitted once T_DownstreamOf_aHM has reached the necessary minimum temperature, for example of 250 degrees Celsius. This minimum temperature is reached significantly faster or not at all depending on the operating state by operating the active heating measure.

It is simultaneously advantageous if the operating strategy comprises further features to generate a best possible result in the context of component protection and emissions reduction. On the one hand, it should be monitored that the temperatures of the active heating measure for example designed as a heating disc, or of all components of the exhaust gas system in general, do not increase to a temperature above the permitted maximum temperature. In particular, in order to prevent this, the post-injection quantity should first be limited or set to zero, and the power of the active heating measure should then be regulated. In addition, a limit of the post-injection quantity in the form of a lambda-guided quantity control is preferably used so that the post-injection can be converted completely in the oxidation catalyst, and does not lead to increased pollutant emissions, in particular HC and/or CO, due to a lack of oxygen in the exhaust gas.

In an advantageous embodiment of the invention, a second heating element is provided, which is provided in addition to the heating element, and which is designed to cause an active introduction of heat energy into the exhaust gas and/or the oxidation catalyst at a second heating point arranged downstream of the heating point, wherein the second heating element is designed as a heating element arranged downstream of the oxidation catalyst or as a heating element provided with the catalytic coating.

In an advantageous embodiment of the invention, it is provided that the particle filter is provided with a second catalytic coating by means of which a second SCR catalyst is formed.

In an advantageous embodiment of the invention, it is provided that the oxidation catalyst is also designed to store nitrogen oxides from the exhaust gas.

Further advantages, features and details of the invention result from the following description of a preferred exemplary embodiment and with reference to the drawings. The features and combinations of features previously specified in the description and the features and combinations of features specified in the following description of figures and/or shown only in the figures can be used not only in the specified combination, but also in other combinations or in isolation, without leaving the scope of the invention.

DETAILED DESCRIPTION OF THE DRAWINGS

Figure 1:
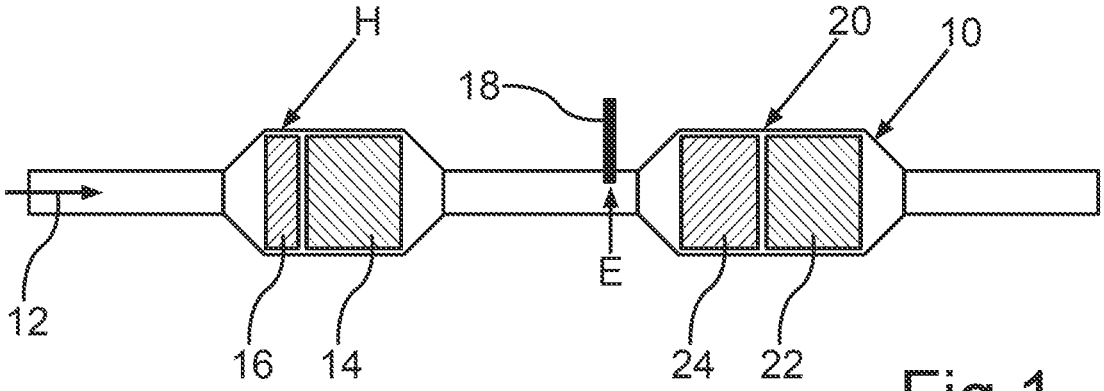
FIG. 1 shows a schematic depiction of an exhaust gas post-treatment device for an internal combustion engine of a motor vehicle.

In the Figures, identical or functionally identical elements are provided with identical reference numerals.

FIG. 1 shows, in a schematic depiction, an exhaust gas post-treatment device 10 for an internal combustion engine of a motor vehicle. The internal combustion engine is preferably designed as a diesel engine. As depicted in FIG. 1 by an arrow 12, the exhaust gas post-treatment device 10 can be flowed through by an exhaust gas. The exhaust gas post-treatment device 10 comprises an oxidation catalyst 14 for example designed as a diesel oxidation catalyst (DOC), which has a catalytic coating, and is thus at least partially formed by the catalytic coating. The catalytic coating, and thus the oxidation catalyst 14, are designed to oxidize constituents contained in the exhaust gas, e.g., unburned hydrocarbons (HC) and carbon monoxide (CO). The exhaust gas post-treatment device 10 additionally has an active heating element 16 also described as an active heating measure, which is designed to actively cause an introduction of heat energy into the exhaust gas, and via the exhaust gas into the oxidation catalyst 14, at a heating point H. In the exemplary embodiment shown in FIG. 1, the heating element is designed as a heating element arranged upstream of the oxidation catalyst 14, and thus upstream of the catalytic coating, wherein the heating element 16 is preferably a heating element which can be operated electrically. It is conceivable that the heating element 16 is free of the catalytic coating of the oxidation catalyst 14. As an alternative, it is conceivable that the heating element 16 is connected to the oxidation catalyst 14, so to speak, and is provided with the catalytic coating. As an alternative or in addition to the heating element 16, another, active heating measure, e.g., a burner, can for example be used, by means of which, for example, a fuel is burned, whereby, for example, heat can be introduced into the exhaust gas at the heating point H.

The exhaust gas post-treatment device 10 additionally comprises a dosing element 18, by means of which a preferably liquid reducing agent can be introduced into the exhaust gas at an introduction point E. It can be seen from FIG. 1 that the introduction point E is arranged downstream of the heating point A, and downstream of the heating element 16, and downstream of the oxidation catalyst 14. In addition, the introduction point E is arranged upstream of an SCR system 20 of the exhaust gas post-treatment device 10. The SCR system 20 has an SCR catalyst 22 and a particle filter 24, which is arranged downstream of the SCR catalyst 22 in the exemplary embodiment shown in FIG. 1. The particle filter 24 is preferably a diesel particle filter. The particle filter 24 can be provided with a further catalytic coating, which is also described as an SCR coating. A further SCR catalyst is formed by the SCR coating. In particular, it is conceivable that the SCR catalyst 22 is also formed by the SCR coating.

An electronic computer not depicted in the Figures is for example provided, by means of which the exhaust gas post-treatment device 10 can be operated, and should in particular be regulated. In particular, by means of the electronic computer, a method for operating the exhaust gas post-treatment device 10 is carried out. By the method, as described in the following in more detail, the exhaust gas post-treatment device 10 can be heated particularly quickly, such that the exhaust gas post-treatment device 10 can post-treat the exhaust gas particularly advantageously.

Figure 2:
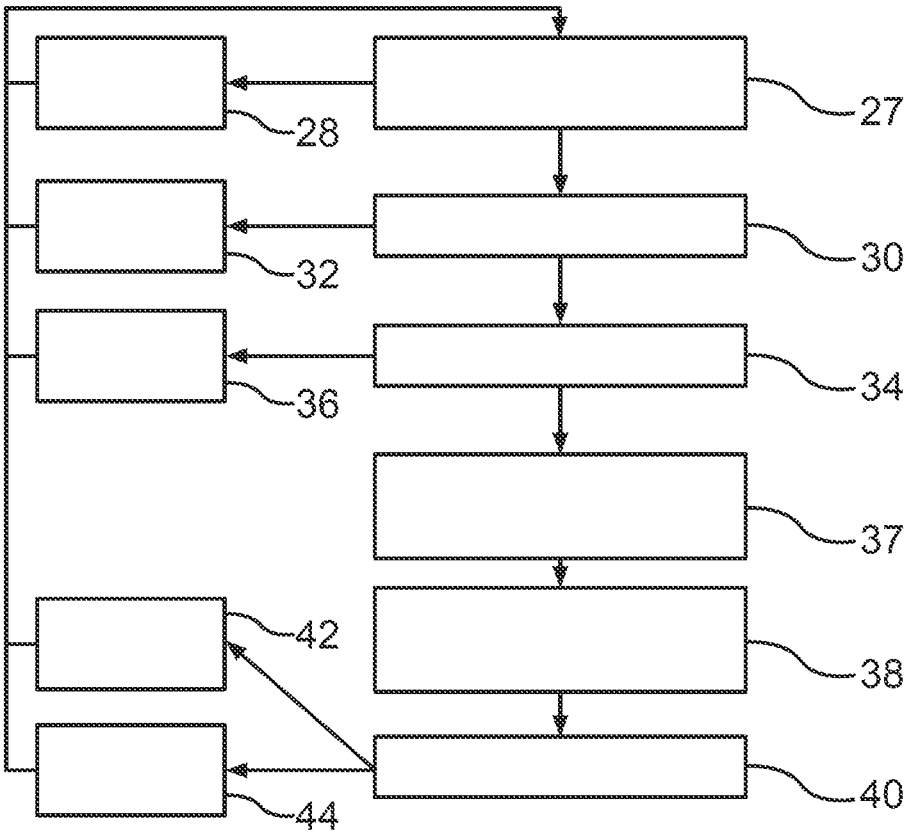
FIG. 2 shows a block diagram depicting a method for operating the exhaust gas post-treatment device.

FIG. 2 shows a block diagram depicting the method. In a block 27, it is determined whether respective target temperatures of the exhaust gas post-treatment device 10 have been reached. A first of the target temperatures is assigned to a temperature in the exhaust gas system 10 downstream of the heating point H and thus downstream of the heating element 16, the temperature also being labelled T_DownstreamOf_aHM. For example, the first target temperature is 250 degrees Celsius. A second of the target temperatures is assigned to the SCR system 20, and is for example 225 degrees Celsius. If, for example, a temperature of the SCR system 20 labelled T_SCR is 225 degrees Celsius, or if T_SCR is greater than 225 degrees Celsius, i.e., if T_SCR corresponds to the second target temperature, or if T_SCR is greater than the second target temperature, and if T_DownstreamOf_aHM is greater than or equal to 250 degrees Celsius, and is thus greater than or equal to the first target temperature, then there is no active heating of the exhaust gas post-treatment device 10 or of the exhaust gas in a block 28. If, however, the first temperature and the second temperature, and thus T_DownstreamOf_aHM and T_SCR, lie below the respectively assigned target temperatures, such that T_DownstreamOf_aHM is lower than 250 degrees, and T_SCR is lower than 225 degrees Celsius, then it is checked in a block 30 whether component protection temperatures for protecting components of the exhaust gas post-treatment device 10 have been exceeded. If this is the case, then there is no active heating of the exhaust gas or of the exhaust gas post-treatment device 10 in a block 32. If, however, the component protection temperatures are not fallen short of, then it is checked in a block 34 whether a minimum temperature for carrying out a post-injection has at least been reached. For example, 250 degrees Celsius is used as the minimum temperature. For example, the minimum temperature is compared with T_DownstreamOf_aHM. If, in the block 34, it is determined that the minimum temperature for carrying out the post-injection (NE) has not been reached, i.e., if, for example, in the block 34, it is determined that T_DownstreamOf_aHM is lower than 250 degrees Celsius, then the exhaust gas, and thus the exhaust gas post-treatment device 10, is for example actively heated, i.e., warmed up, in a block 36 by means of the heating element 16 for example designed as a heating element which can be operated electrically, whereby the post-injection is not carried out.

If, however, it is determined in a block 34 that the minimum temperature for carrying out the post-injection has been reached, i.e., presently, for example, that T_DownstreamOf_aHM is 250 degrees Celsius or more, then a temperature rise, by which the second temperature of the SCR system also described as an actual temperature or labelled T_SCR_Actual should be increased, is calculated in a block 37, so that the second temperature of the SCR system 20, and thus the actual temperature or T_SCR-Actual, reaches the assigned target temperature, presently 225 degrees Celsius. The temperature rise is also labelled Intended_T-Rise, and thus results from:

$$\text{Intended_T-Rise}=\text{T_SCR_Intended}-\text{T_SCR_Actual}.$$

The target temperature assigned to the second temperature of the SCR system 20, presently 225 degrees Celsius, is labelled T_SCR_Intended.

In a block 38, a control difference is calculated. The control difference results from:

$$\text{Control difference}=\text{Intended_T_Rise}-\text{DeltaT_aHM}.$$

$$\text{DeltaT_aHM}=\text{heat input power}/(\text{exhaust gas mass flow}\cdot\text{CP}).$$

The heat input power should be understood as heat input power of the active heating measure.

In a block 40, it is checked whether the control difference can be reached by means of the active heating measure, in particular without carrying out the post-injection. In other words, in the block 40, it is checked whether the control difference is less than 0. If this is the case, then in a block 42, an active heating is carried out by means of the active heating measure, in particular without the post-injection being carried out. If, however, the control difference cannot be reached by means of the active heating measure, and without carrying out the post-injection, then in a block 44, an active heating is implemented both by means of the active heating measure and by carrying out the post-injection, which is preferably a late post-injection.

In particular, it is conceivable to check in the block 40 whether the control difference can be reached by means of the active heating measure alone, i.e., without carrying out the post-injection, within a period of time which can be pre-determined, and thus in X seconds. If this is the case, then the method is continued in the block 42; if this is not the case, then the method is continued in the block 44. Preferably, X is 100 to 200 seconds. In other words, the period of time for example lies in a range from 100 seconds to 200 seconds inclusive.

The invention claimed is:

1. A method for operating an exhaust gas post-treatment device for an internal combustion engine of a motor vehicle, wherein exhaust gas from the internal combustion engine flows through the exhaust gas post-treatment device, and wherein the exhaust gas post-treatment device comprises: an oxidation catalyst with a first catalytic coating, a first heating element disposed upstream of the oxidation catalyst or with the first catalytic coating and configured to heat the exhaust gas and/or the oxidation catalyst at a first heating point, a dosing element configured to introduce a reducing agent is into the exhaust gas at an introduction point downstream of the oxidation catalyst and the first heating point, and an SCR system having a first SCR catalyst disposed downstream of the introduction point, the method comprising:

determining: that a temperature downstream of the first heating point and a temperature of the SCR system are below respective target temperatures, that component protection temperatures are not exceeded, and that a minimum temperature of the internal combustion engine for carrying out a post-injection has been reached or exceeded;

calculating a temperature rise by which the temperature of the SCR system is to be increased such that the temperature of the SCR system reaches its respective target temperature;

determining whether the temperature rise can be achieved within a pre-determined duration by the first heating element without carrying out the post-injection;

in response to determining that the temperature rise can be achieved within the pre-determined duration by the first heating element without carrying out the post-injection, then the exhaust gas, and thus the SCR system, via the first heating element, without carrying out the post-injection; and in response to determining that the temperature rise cannot be achieved within the pre-determined duration by the first heating element without carrying out the post-injection, heating the exhaust gas, and thus the SCR system, via the first heating element and by carrying out the post-injection.

2. The method according to claim 1, wherein the exhaust gas post-treatment device further comprises a second heating element disposed downstream of the oxidation catalyst or with the first catalytic coating and configured to heat the exhaust gas and/or the oxidation catalyst at a second heating point downstream of the first heating point.

3. The method according to claim 1, wherein the SCR system has a particle filter with a second catalytic coating via which a second SCR catalyst is formed.

4. The method according to claim 1, wherein the oxidation catalyst stores nitrogen oxides from the exhaust gas.

* * * * *